US009717341B1

(12) United States Patent
Gibson

(10) Patent No.: US 9,717,341 B1
(45) Date of Patent: Aug. 1, 2017

(54) CHAIR FRAME

(71) Applicant: MAJOR PRODUCTIONS/ SIDNEY GIBSON LIMITED, Stratford (CA)

(72) Inventor: Sidney Gibson, Stratford (CA)

(73) Assignee: Major Productions/Sidney Gibson Limited, Stratford, ON (CA)

( * ) Notice: Subject to any disclaimer, the term of this patent is extended or adjusted under 35 U.S.C. 154(b) by 0 days.

(21) Appl. No.: 15/142,534

(22) Filed: Apr. 29, 2016

(51) Int. Cl.
*A47C 7/16* (2006.01)
*A47C 7/00* (2006.01)

(52) U.S. Cl.
CPC ..... *A47C 7/002* (2013.01); *A47C 7/16* (2013.01)

(58) Field of Classification Search
CPC ..... A47C 7/002; A47C 7/16
USPC ..... 297/440.13, 440.14, 451.8
See application file for complete search history.

(56) References Cited

U.S. PATENT DOCUMENTS 4,712,837 A * 12/1987 Swilley ..... A47C 4/03 297/440.13 X
6,247,754 B1 * 6/2001 Vanderaue ..... A47C 4/021 297/440.13
2016/0220027 A1 * 8/2016 Milde ..... A47C 7/16

* cited by examiner

*Primary Examiner* — Anthony D Barfield

(57) ABSTRACT

A chair, according to the present invention has an inverted pyramidal shape primarily determined by triangular side and back frames of the chair. The frames include two side frames and a back frame and preferably a smaller front frame. Each side frame is secured to a central portion of a pedestal type base and extends upwardly and outwardly from the base. Each frame adjacent an upper edge is mechanically secured to an adjacent frame with the frames cooperating to form a 'U' shape generally at the height corresponding to side arms of the chair. A support seat is provided in the frames and the side frames define arms of the chair. A back support is secured to the back frame at a position intermediate the height of the back support with a lower edge of said back support joining with a rear edge of the support seat. The side frames and back frame between said seat and an upper edge of the frames are of a triangular or truncated triangular shape.

12 Claims, 11 Drawing Sheets

CHAIR FRAME

FIELD OF THE INVENTION

The present application relates to a modular chair that is easy to assemble and cost-effective to manufacture.

BACKGROUND OF THE INVENTION

Adirondack chairs and Muskoka chairs have distinctive appearances and remain popular with respect to recreational properties. These chairs are typically made of wood, require significant assembly and/or are sold as an assembled product. In addition the frames of the chairs are prone to racking.

There remains a need for a similar type of chair that is cost-effective to manufacture and advantageously uses a series of modular components that cooperate to provide a structural durable chair.

SUMMARY OF THE INVENTION

A modular chair according to the present invention, comprises a base supporting two side frames and a back frame. Each side frame is secured to a central portion of the base and extends upwardly and outwardly from the base. The frames, adjacent an upper edge are mechanically secured to an adjacent frame with the frames cooperating to form a U-shaped opening generally at a height corresponding to the height of the side arms of the chair. A chair seat is supported in the frames adjacent an upper edge of the base with the front edge of the seat being located between and below arms of the U-shaped opening. A back support is secured to the back frame at a position intermediate the height of the back support with the lower edge of the back support joining with a rear edge of the chair seat. The side frames and back frame between the chair seat and an upper edge of the frames are of a triangular or truncated triangular shape.

According to an aspect of the invention, the frames are of a triangular shape and the base includes four leg portions defining an X configuration with the leg portions centrally secured.

According to further aspect of the invention, the side frames have a horizontal upper surface defining arms of the chair.

In a further aspect of the invention, the back frame includes a horizontal upper surface at the same height as the upper surface of the side frames.

According to a further aspect of the invention, the chair includes a triangular front frame secured to the two side frames and said base. The front frame engages and supports the bottom surface of the chair seat.

In a further aspect of the invention, each side frame forms a generally 90° corner configuration with said back frame.

In a further aspect of the invention, each side frame and back frame include parallel wall portions extending downwardly and inwardly towards the base and connect with the base in a corner configuration.

In a further aspect of the invention, each side frame and the back frame are of a similar size.

BRIEF DESCRIPTION OF THE DRAWINGS

Preferred embodiments of the invention are shown drawings wherein.

DETAILED DESCRIPTION OF THE PREFERRED EMBODIMENTS

Figure 1:
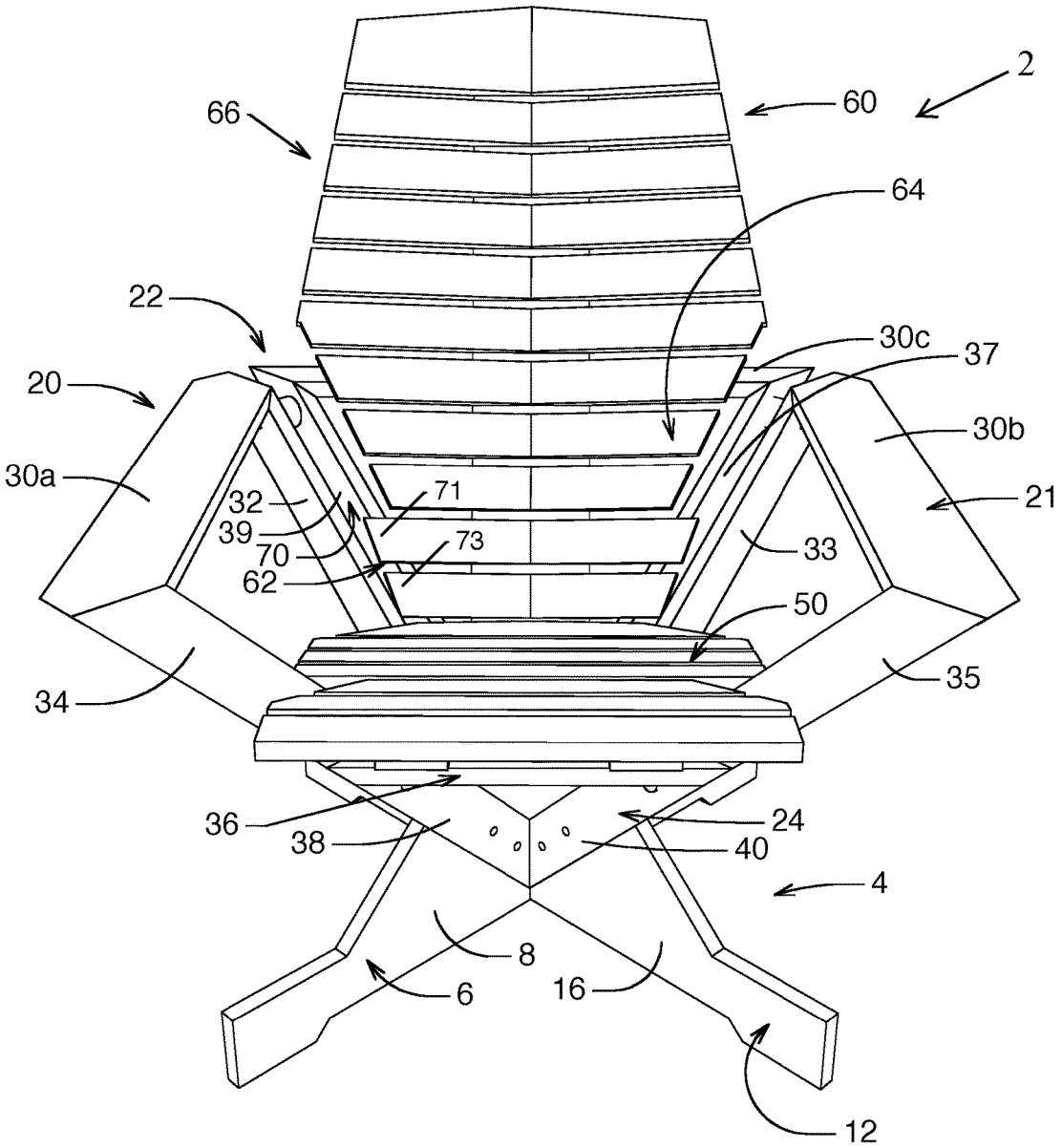
FIG. 1 is a front perspective view of the chair.
Figure 2:
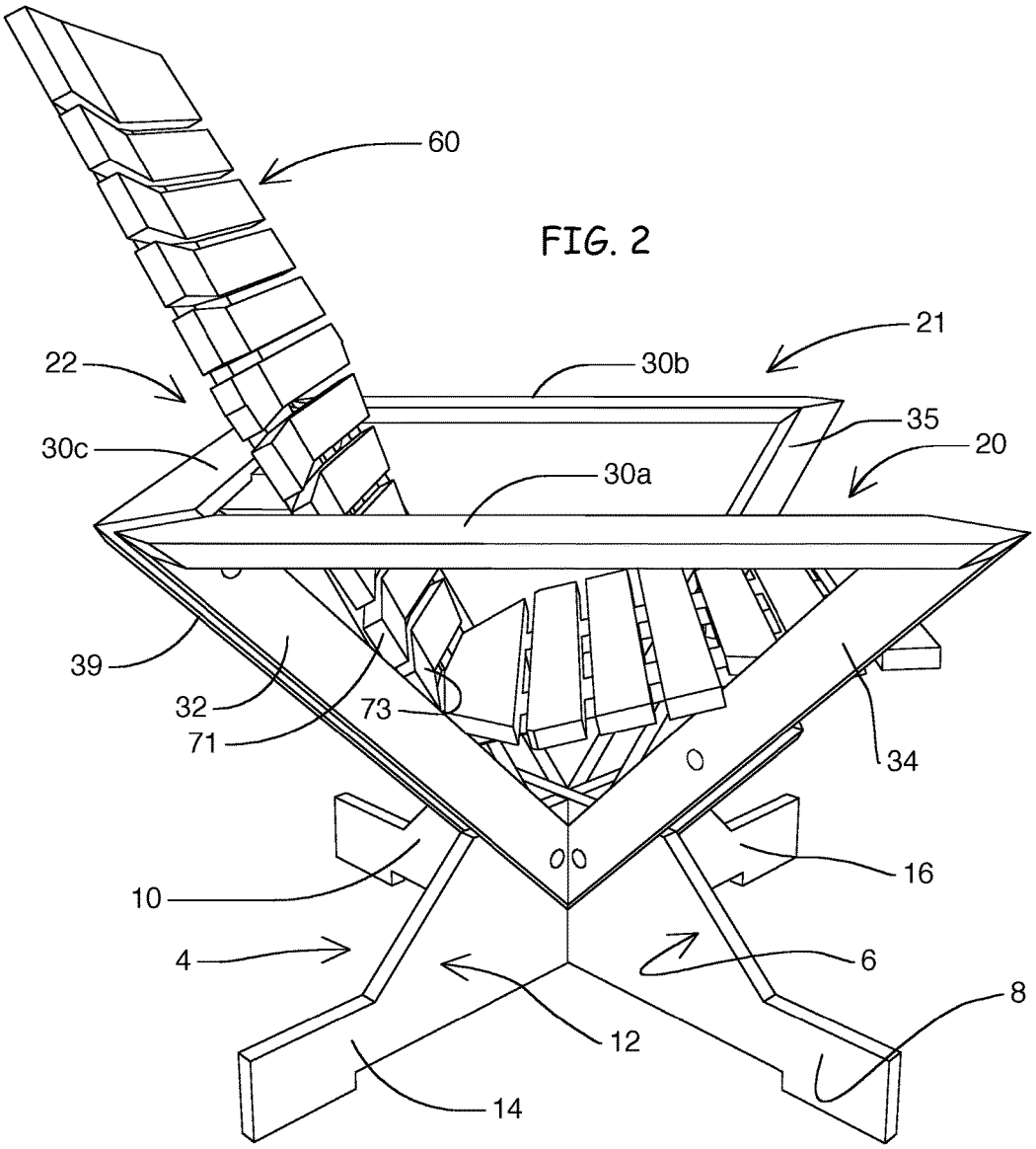
FIG. 2 is a side perspective view of the chair.
Figure 15:
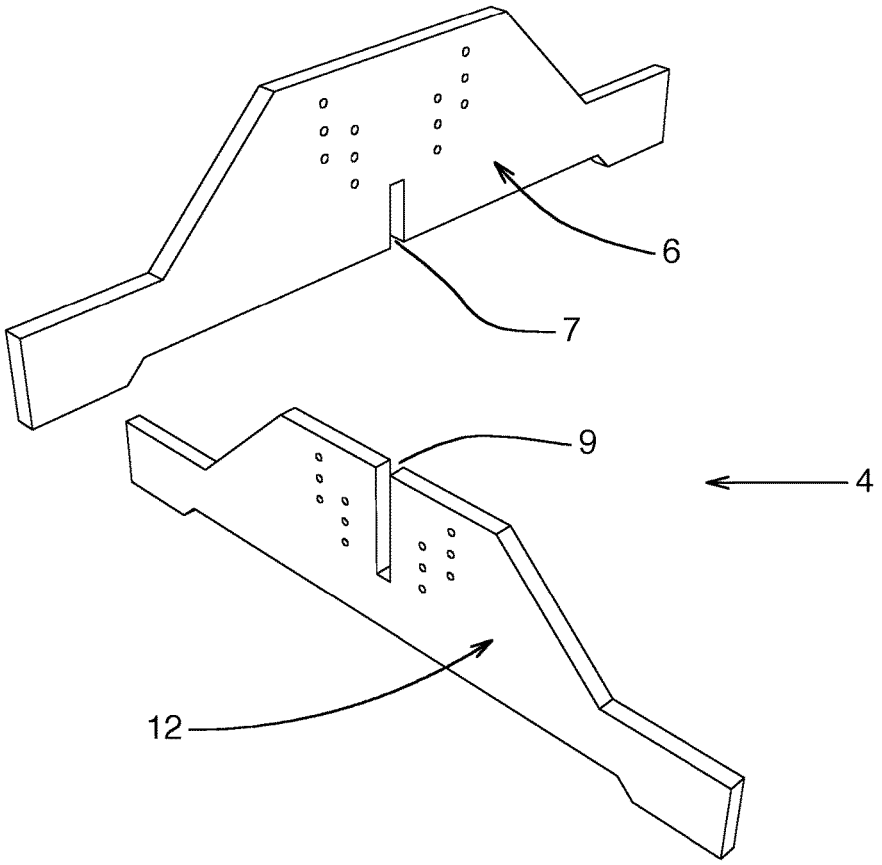
FIG. 15 is an exploded perspective view of the base components.

The modular chair 2, shown in FIGS. 1 and 2, has a two piece base 4 comprising base component 6 having a downwardly opening slot 7 that is received in an upwardly slot 9 of the base component 12 to define a 'X' type configuration (see FIG. 15). Base component 6 includes legs 8 and 10 to either side of the downwardly opening slot and base component 12 includes legs 14 and 16 either side of the upwardly opening slot. The two piece base 4 forms a pedestal type support of the chair.

The chair includes two opposed side frames 20 and 21, back frame 22 and a front frame 24. All of these frames are preferably of a triangular shape with each frame secured to and reinforcing the two piece base 4. As shown in FIG. 1, the side frames, front frame and back frame all engage a central portion of the two piece base 4 and provide a strong securement of the frames to the two piece base and each other. The connected frames provide a triangulated structure that direct forces downwardly into the central portion of the two piece base and this structure is not prone to racking.

Figures 3, 4:
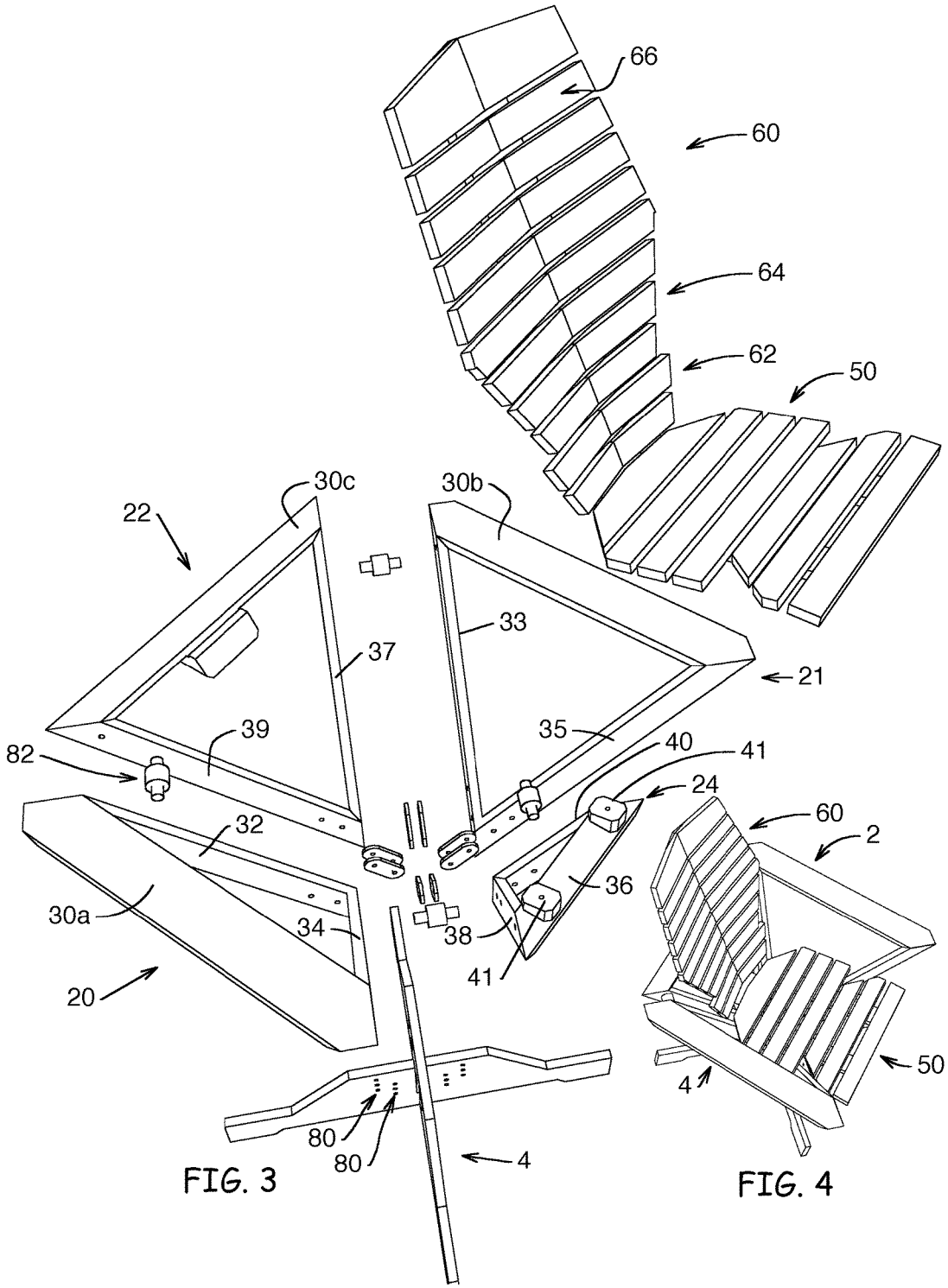
FIG. 3 is an exploded perspective view of the chair.
FIG. 4 is a top perspective view of chair.

The particular attachment of the frames to the two piece base 4 can be appreciated from the exploded perspective view of FIG. 3. Each of the frame members engage the base components 6 and 12 centrally at an intersection of the 'X' configuration and each of the frames is mechanically secured to the base components and to adjacent frames. With this arrangement, the two piece base 4 and the frames all cooperate to provide an effective structure transferring loads through the frames to the central portion of the two piece base and out to the legs. The base components 6 and 12 also include two series of vertically spaced securing ports 80 with one series of ports being offset from the other. These securing ports 80 allow the frames to be secured to the two piece base at three different heights and a user can choose the appropriate height when the chair is assembled. This height adjustment varies the height of chair seat 50.

At an upper portion between adjacent frames, a spacer 82 is positioned and in combination with the two piece base, define a gap 70. This gap 70 between adjacent frames, accommodates stacking of chairs that is described in later figures.

Each of the side frames 20 and 21 and the back frame are similar in shape and size. Side frame 20 includes a horizontal top member 30*a* and two downwardly extending support members 32 and 34. Side frame 21 includes a horizontal top member 30*b* and two downwardly extending support members 33 and 35. Side frames 20 and 21 are of the same structure with the exception that the top securing port for joining the side frame with the back frame is in the opposite downwardly extending support member.

Back frame 22 includes a horizontal top member 30*c* and two downwardly extending support members 37 and 39. The top members 30*a*, 30*b* and 30*c* are preferably at the same height when the chair is assembled. Front frame 24 includes a horizontal member 36 and two downwardly and inwardly extending support members 38 and 40. The side frames and back frame at the height of the chair arms is 'U' shaped, in plan view, however each side frame converges towards the chair seat. The connected frames preferably have an upside down pyramidal shape.

Additional details of the front frame is shown in the exploded perspective view of FIG. 3. The front frame includes securing blocks 41 which are secured to the horizontal member 36 and are used as part of the securement of the seat portion 50 to the front frame. The chair further includes a separate back support 60 having a stepped out lower portion 62, a reduced width portion 64, and a top portion 66. The reduced width portion 64 exposes part of the gap 70 between connected side and back frames. The gap 70 is used for receiving a rearward extending leg of the base during stacking of chairs.

Figure 5:
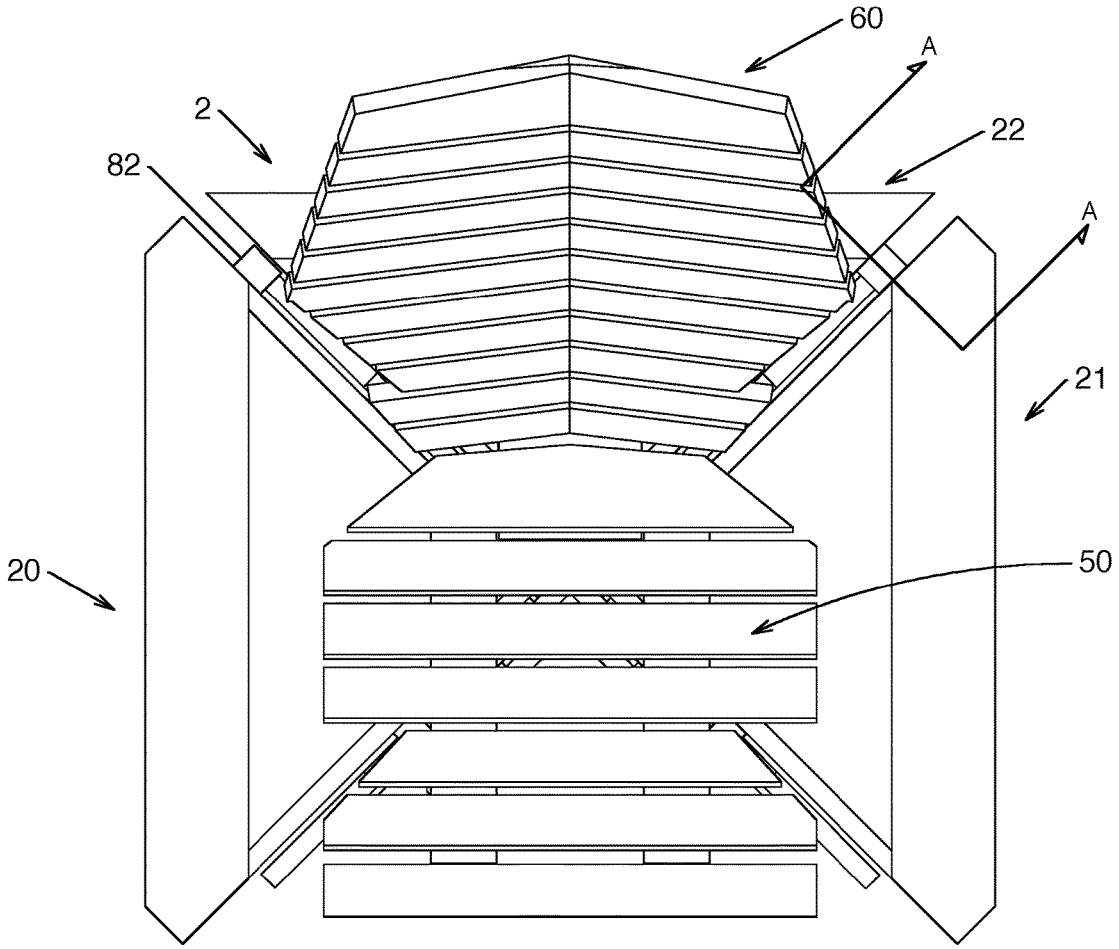
FIG. 5 is a top view of the chair.

In FIG. 5, it can be seen that the legs of the two piece base 4 are aligned with the gaps 70 between connected frame members. This particular alignment partially created by the shape of the back support 60 and the securement of the frames, is used for stacking.

Figure 6:
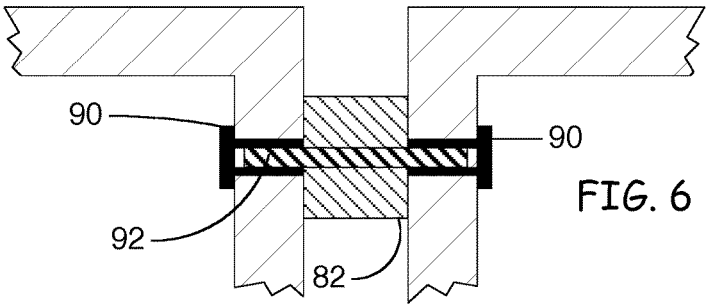
FIG. 6 is a sectional view taken through line A-A of FIG. 5.

In FIG. 6, a sectional view through a typical mechanical connection used for securing of the frames is shown. Each frame includes a port that receives a threaded cap nut 90. The spacer 82 is provided between the two frames and a threaded rod 92 passes through the spacer and engages each of the threaded cap nuts 90. The cap nuts can then be rotated to secure the frame members together. As can be appreciated, other fastening arrangements can be used, however the illustrated mechanical connection has proven to be effective.

Figure 7:
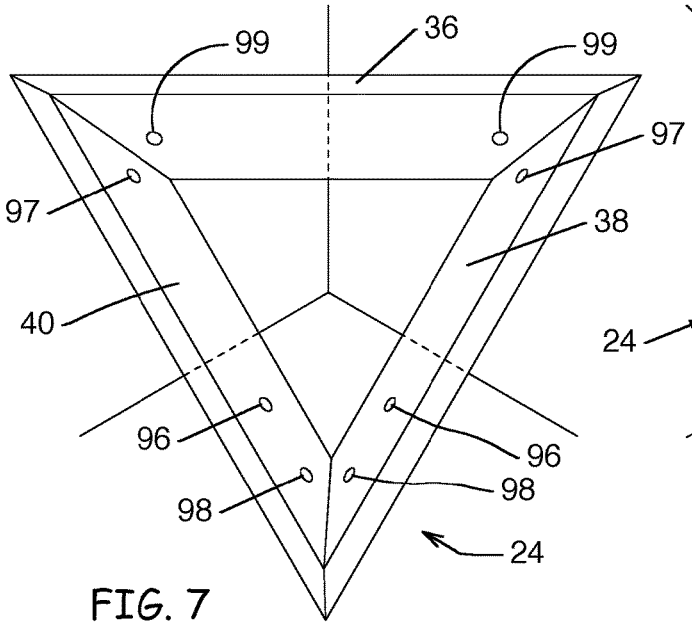
FIG. 7 is a front view of the front frame of the chair.
Figure 8:
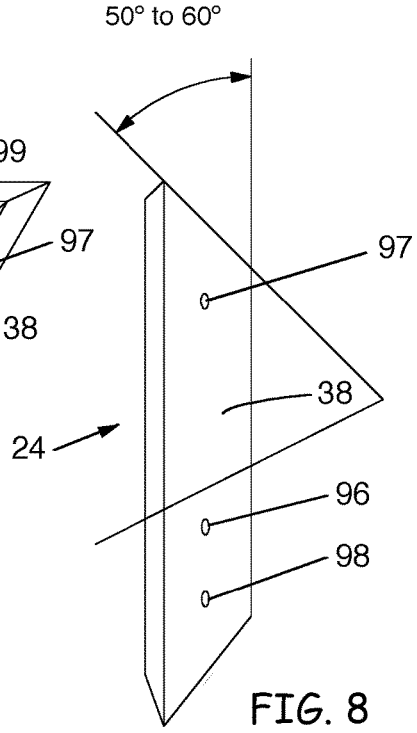
FIG. 8 is a side view of the front frame of the chair shown in FIG. 7.
Figure 9:
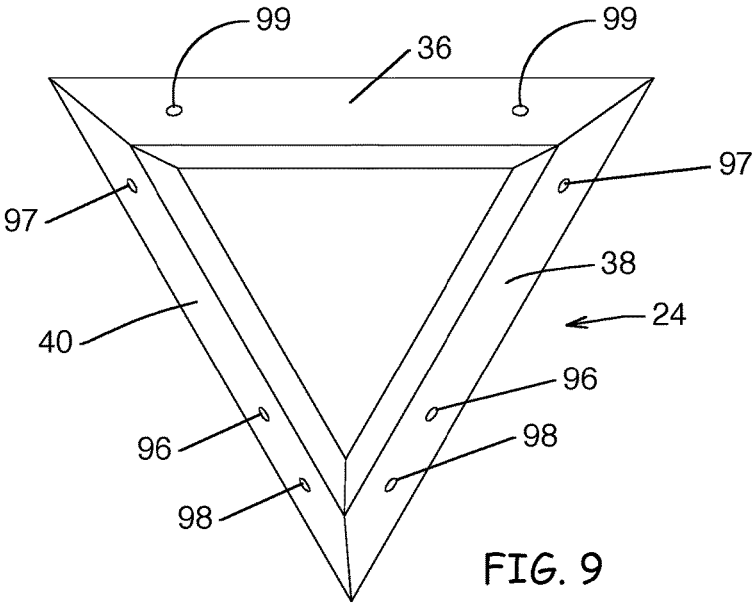
FIG. 9 is rear view of the front frame shown in FIG. 7.

Details of the front frame 36 are shown in FIGS. 7 through 9 and include a series of ports for securing components. At the bottom of the front frame as shown in FIG. 7, two ports 96 and 98 are provided in each of the support members in the lower corner and are used as part of the securement to the base. The support members include upper securing ports 97 used to connect with the side frames and the horizontal member 36 includes securing ports 99 used to secure the chair seat. FIG. 8 shows the pitch angle of between 50 and 60 degrees of the three sides of the front frame. A preferred angle is 55 degrees.

Figure 10:
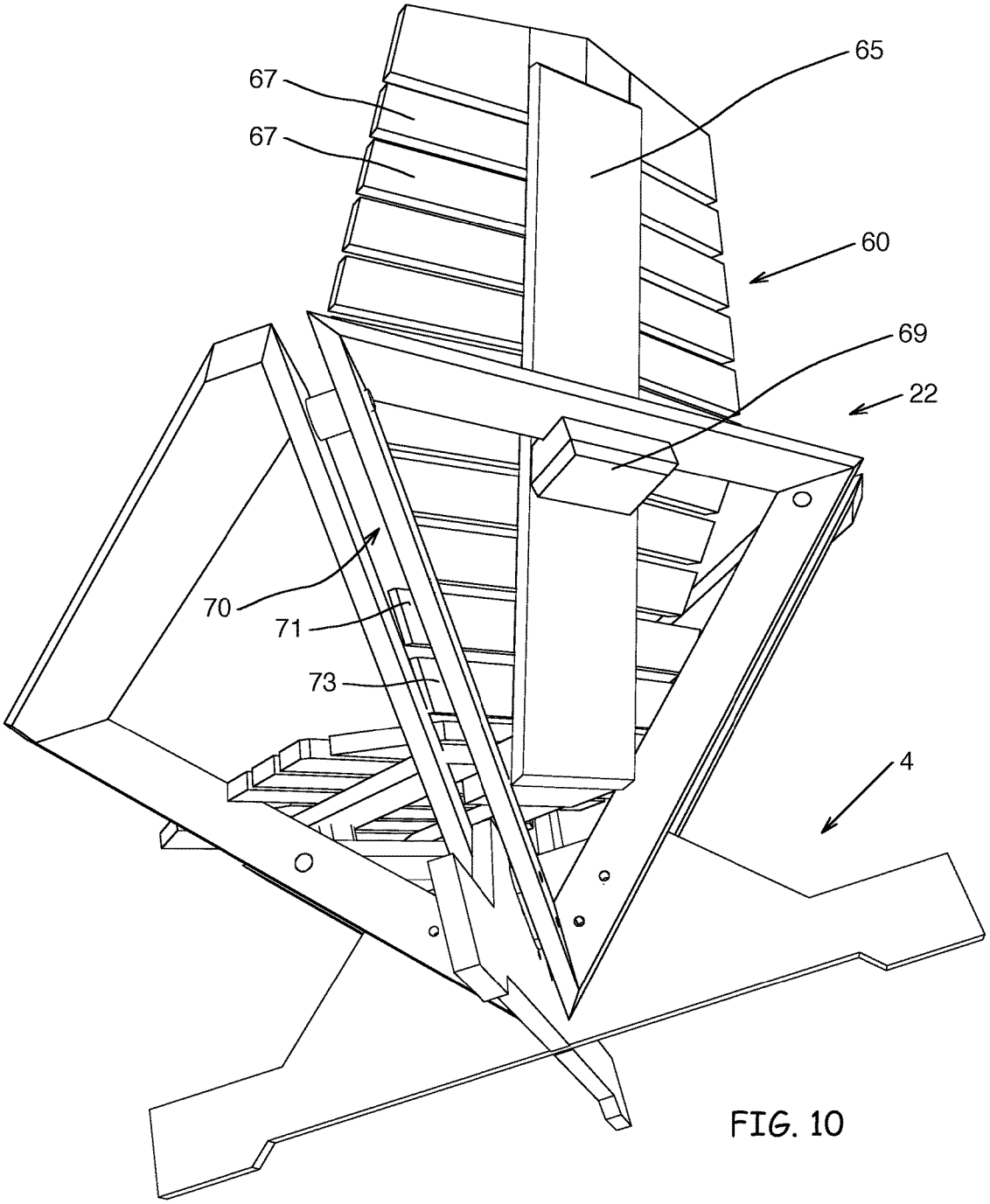
FIG. 10 is a rear perspective view of the chair.

FIG. 10 shows a rear view of the chair and details of the back support 60. The back support includes the central support member 65 that joins the individual slats 67. The central support 65 also includes a flange block 69 that is used as part of a mechanical securement of the back support 60 to the horizontal member of the back frame 22. FIG. 10 also illustrates the gap 70 between the back frame 22 and each side frame 20 and 21. It can be appreciated that stepped-out portion 62 includes two slats 71 and 73 that project into the slot 70. The projecting portion of slat 71 provides a stop surface for supporting of a leg of the chair when two chairs are stacked (see FIG. 12).

Figure 11:
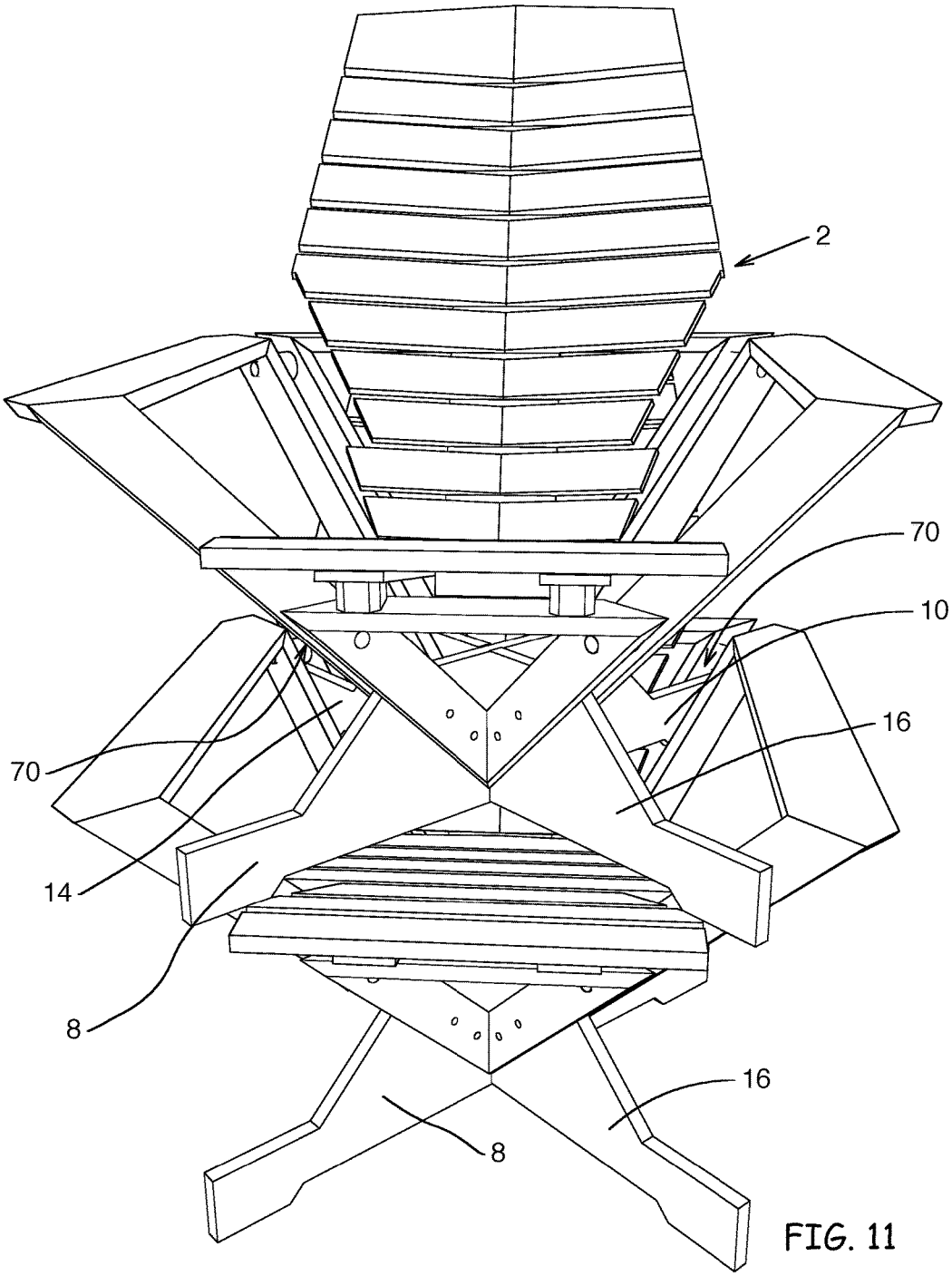
FIG. 11 is a front perspective view showing two stacked chairs.
Figure 12:
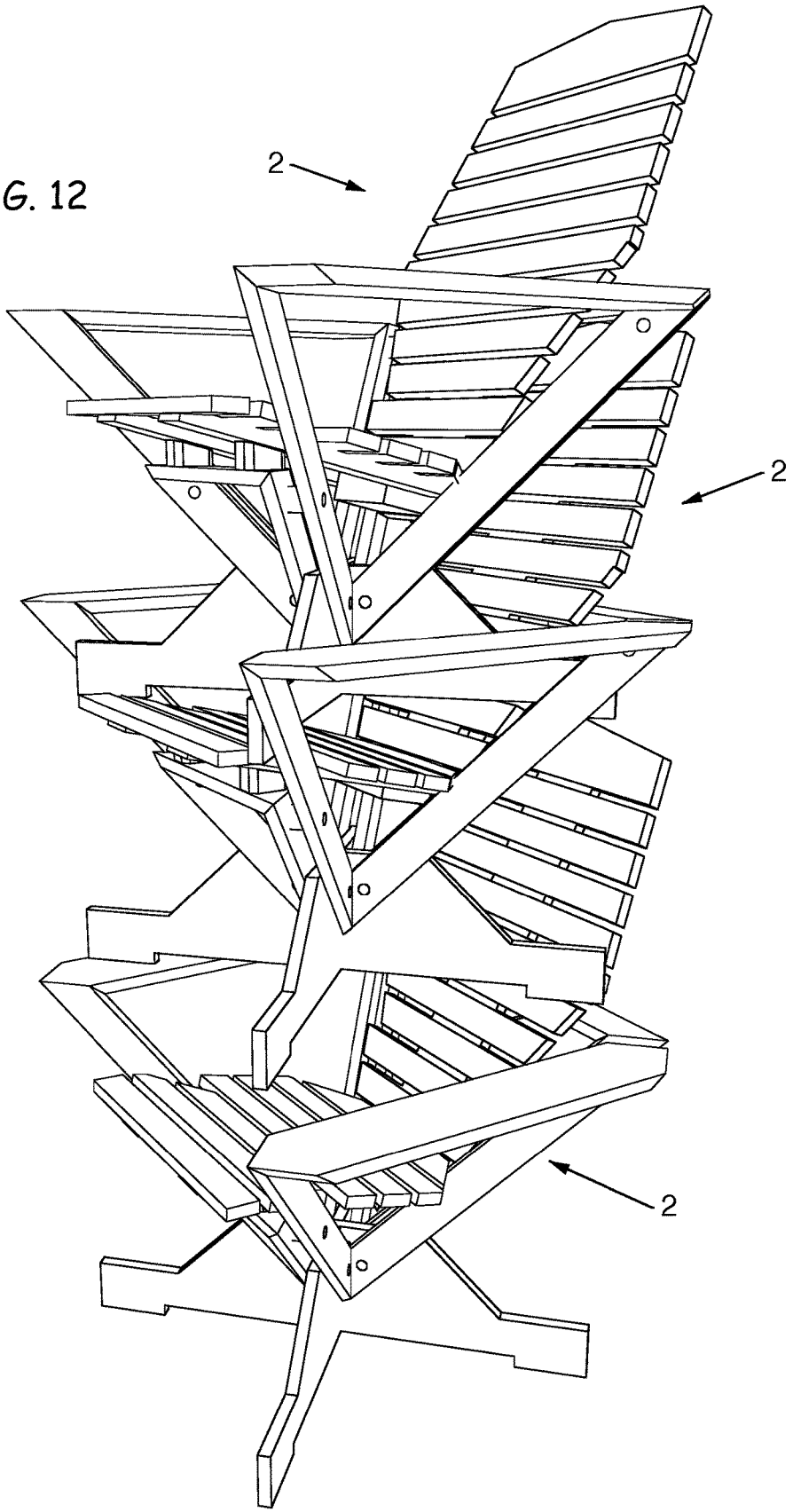
FIG. 12 is a side perspective view showing two stacked chairs about to be stacked with a bottom chair.

FIG. 11 illustrates two chairs in a stacked configuration with rear legs 10 and 14 of the upper chair located in the slot 70 provided between the side frames and the back frame. The legs 10 and 14 are supported on the slats 71 of the lower chair with legs 8 and 16 supported on the front of the seat portion 50. FIG. 12 shows two stacked upper chairs about to be stacked on a lower chair.

Figure 13:
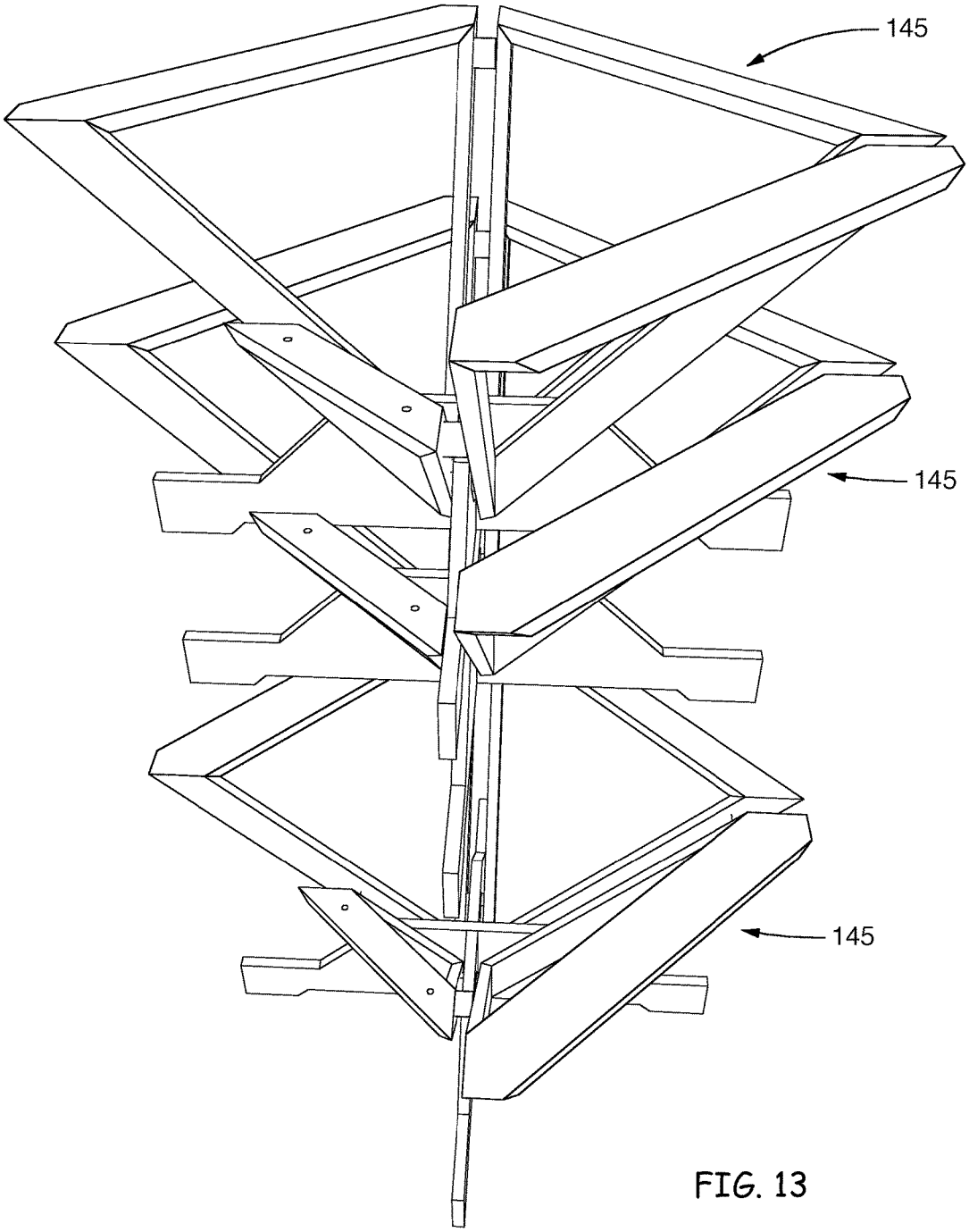
FIG. 13 is a side perspective view showing two stacked chair bases about to be stacked with a lower chair base.

FIG. 13 shows three chair frames 145 without chair seats with the upper two chair frames being in a stacked configuration and about to be stacked on a lower chair frame.

Figure 14:
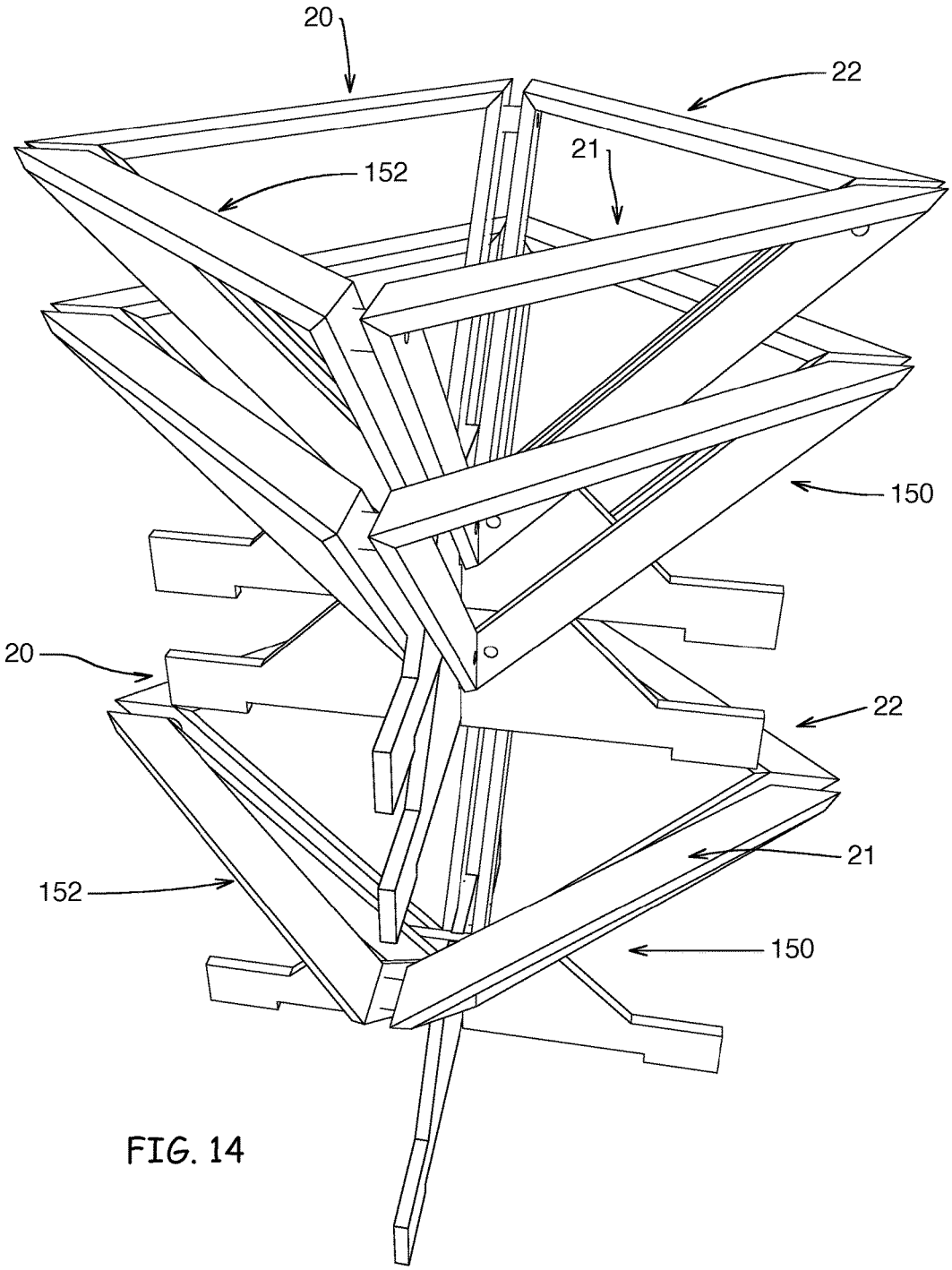
FIG. 14 is a perspective view showing a modified embodiment where two modified support bases are stacked and these support bases are about to be stacked on a bottom support base.

FIG. 14 shows a modified support base 150 that operates in a similar manner and can be used for supporting other objects or surfaces such as a support base for a planter, a table surface or a bench structure. Two support bases 150 are shown in a stacked configuration and are about to be stacked with a bottom support base. In this modified structure the front frame of the chair has been replaced with a full-size front frame 152. In this way a large planter or horizontal surface can be secured to or placed on the support base. This support base 150 allows the modular components to be used in a different combination for forming related structures such as side tables, coffee tables or a bench structure (multiple support bases) as some examples of related products that can utilize the support base.

The connected frames form a double strut type structure at each corner.

The preferred two piece base 4 is of an 'X' shape with each triangular frame reinforcing one of the 90 degree cells of the 'X' shape. The preferred embodiment of the chair uses the two piece base however the base need not be two pieces and can be made in other ways. Alternative pedestal type bases can be used particularly if stacking is not required. If an alternate configuration of the base is used the frames may be of a modified triangular structure, truncated triangular structure or have the lower portion modified for engagement with the base. As can be appreciated in the preferred chair, the rear legs extend through the slots 70 between connected frames when chairs are stacked to maintain a vertical orientation of the stacked chairs.

The components of the modular chair can be made of wood or a reinforced plastic material. In some cases it is desirable to mold the individual components as a single one piece component. For example the components can be made of a molded plastic, reinforced plastic, recycled plastic, fiberglass or epoxy component. It is also possible to mold the chair as a one piece component or manufacture the base and frame members as a one piece component.

Although preferred embodiments of the invention have been described in detail it will be understood by those skilled in the art that variations may be made thereto without departing from the claimed invention. The detailed description and various examples have been provided to assist in understanding the principles of the present invention but the applicant is not limited to the preferred embodiment or the specific examples.

The embodiments of the invention in which an exclusive property or privilege is claimed are defined as follows:

1. A chair comprising a pedestal type base having a central portion supporting two side frames and a back frame at a raised position each side frame being secured to said central portion of said pedestal type base and extending upwardly and outwardly from said central portion; each frame adjacent an upper edge being mechanically secured to an adjacent frame with said frames cooperating to form a 'U' shape generally at the height corresponding to side arms of said chair;

a chair seat supported in said frames adjacent an upper edge of said base with a front edge of said seat located between arms of said U shape; a back support secured to said back frame at a position intermediate the height of said back support with a lower edge of said back support joining with a rear edge of said chair seat, and wherein said side frames and back frame between said seat and an upper edge of said frames being of a triangular or truncated triangular shape.

2. A chair as claimed in claim 1 wherein said side frames have a horizontal upper surface defining arms of said chair.

3. A chair as claimed in claim 2 wherein said back frame includes a horizontal upper surface at the same height as said upper surface of said side frames.

4. A chair as claimed in claim 3 including a triangular front frame secured to said side frames and said base, said front frame engaging and supporting a bottom surface of said chair seat.

5. A chair as claimed in claim 3 wherein one side of each side frame forms a corner connection with an adjacent side of said back frame.

6. A chair as claimed in claim 5 wherein each side frame and said back frame include wall portions extending downwardly and inwardly towards said base at the corner connection of said frames.

7. A chair comprising a base supporting two side frames and a back frame; each side frame being secured to a central portion of said base and extending upwardly and outwardly therefrom; each frame adjacent an upper edge being mechanically secured to an adjacent frame with said frames cooperating to form a 'U' shape generally at the height corresponding to side arms of said chair;

a chair seat supported in said frames adjacent an upper edge of said base with a front edge of said seat located between arms of said U shape; a back support secured to said back frame at a position intermediate the height of said back support with a lower edge of said back support joining with a rear edge of said chair seat, and wherein said side frames and back frame between said seat and an upper edge of said frames being of a triangular or truncated triangular shape; and wherein said frames are of a triangular shape and said base includes 4 leg portions defining an X configuration with said leg portions centrally secured.

8. A chair as claimed in claim 7 wherein said side frames have a horizontal upper surface defining arms of said chair.

9. A chair as claimed in claim 8 wherein said back frame includes a horizontal upper surface at the same height as said upper surface of said side frames.

10. A chair as claimed in claim 9 including a triangular front frame secured to said side frames and said base, said front frame engaging and supporting a bottom surface of said chair seat.

11. A chair as claimed in claim 9 wherein one side of each side frame forms a connection with an adjacent side of said back frame.

12. A chair as claimed in claim 11 wherein each side frame and said back frame include wall portions extending downwardly and inwardly towards said base at the corner connection of said frames.

* * * * *